United States Patent [19]

Sakosky

[11] Patent Number: 4,765,208

[45] Date of Patent: Aug. 23, 1988

[54] DEVICES FACILITATING A QUICK AND TROUBLE-FREE OPENING OF BEER AND OTHER BEVERAGE CANS

[76] Inventor: Richard C. Sakosky, 4884 Tall Oaks Dr., Dayton, Ohio 45414

[21] Appl. No.: 423,065

[22] Filed: Sep. 24, 1982

[51] Int. Cl.[4] ..... B67B 7/00

[52] U.S. Cl. ..... 81/3.55

[58] Field of Search ..... 81/3.34, 3.38 R, 3.38 A, 81/3.4, 3.44, 3.46 R, 3.46 A, 3.1 R, 3.07, 3.55, 3.57; 294/25, 26; 7/151; D8/33, 34, 40; 220/285

[56] References Cited

U.S. PATENT DOCUMENTS

| | | | |
|---|---|---|---|
| 706,911 | 8/1902 | Dunham | 81/3.46 R |
| 1,035,008 | 8/1912 | Hendrick | 294/25 X |
| 1,955,750 | 4/1934 | Jones | 220/285 |
| 1,963,007 | 6/1934 | Week | 81/3.46 A |
| 2,503,683 | 4/1950 | Perkins | 81/3.1 R X |
| 3,495,284 | 2/1970 | Weingardt | 81/3.46 R X |
| 4,174,130 | 11/1979 | Mayfield | 294/25 |
| 4,253,352 | 3/1981 | O'Neal | 81/3.46 R |

*Primary Examiner*—Debra Meislin
*Attorney, Agent, or Firm*—Jerome P. Bloom

[57] ABSTRACT

The invention provides apparatus facilitating a quick and trouble-free opening of beer and other beverage cans characterized by a portion of the body thereof being peripherally bounded, at least in part, by a line wherein the can is structurally weakened and having attached thereto a tab-like operating member for breaking it free to produce an opening in the can of which it forms a part. Embodiments comprise a device which includes a portion for mount thereof to a finger or thumb of a hand and another portion providing means to insert under and provide a wedge in backing relation to the tab-like operating member including a base for rocking thereof on the body of the can to which it is applied to bias and carry therewith the tab-like member, to provide for its required function. Preferred embodiments of the invention are formed from a single strip of material and preferably of stainless steel.

15 Claims, 1 Drawing Sheet

12
10
14
16
21
19
18
21

12
10
14
24
34
26
32
29
21
22
28

12
10
26
28
32
34
16
14
24
22

12
10
34
14
26
29
32
16
24
28
22

10
18
14
12

25
30
31
18'
36

12
10
14
18
21
19
16'
21

25
30
24
26
34
29
28
32
36
22

DEVICES FACILITATING A QUICK AND TROUBLE-FREE OPENING OF BEER AND OTHER BEVERAGE CANS

BACKGROUND OF THE INVENTION

This invention relates to new and improved devices facilitating a quick and trouble-free opening of beer and other beverage cans which are characterized by a portion of their top being peripherally bounded, at least in part, by a score line or other type of structural weakening and having attached thereto a lever, ring or other tab-like operating member for breaking thereof free from, and thereby producing an opening in, the body of the can.

In the manufacture of such a can the operating member is normally installed to tightly hug its top surface. Futhermore, the end of this operating member remote from that portion of the can to which it connects will normally lie immediately adjacent the base of an upstanding rim which peripherally bounds the top of the can. The construction and arrangement in this respect usually makes it difficult to readily pry the operating member from the top of the can so it can be easily manipulated and particularly difficult to do so without the chance of injury to the finger or fingernail of the person attempting to open the can.

For example, to produce an opening of a can of the type described, the attached operating member must first be pried away from the top surface of the can to a level above the bounding rim before it can be firmly grasped between the fingers and pulled outward to achieve its attended function. The only way that one can pry up the operating member without a tool is to insert one end of a finger between the rim and the outermost end of the operating member and pry it outwardly by engaging a fingernail under the edge thereof. This edge is oftentimes somewhat sharp and in the process of prying the operating member outwardly from the top surface of the can, one can injure the finger applied or break or otherwise damage the fingernail. This has for some time been a serious problem, particularly to those who must frequently serve the contents of such cans on a daily basis.

Much time and money has heretofore been expended in efforts to solve the noted problem. In spite of this the problem has continued to exist up to the time of the present invention, which does provide a most satisfactory solution.

Attention is directed to the following Letters Patent for a consideration of the state of the prior art:

R. W. Miller—U.S. Pat. No. 4,309,921—Jan. 12, 1982
G. L. O'Neal—U.S. Pat. No. 4,253,352—Mar. 3, 1981
N. R. Goldberg—U.S. Pat. No. 4,120,216—Oct. 17, 1978
R. Zuideveld—U.S. Pat No. 3,870,189—Mar. 11, 1975
C. C. Oblander—U.S. Pat. No. 3,235,122—Feb. 15, 1966
H. N. Bliss—U.S. Pat. No. 2,939,605—June 7, 1960
W. M. Thompson—U.S. Pat. No. 2,775,815—Jan. 1, 1957
J. E. Socke—U.S. Pat. No. 2,334,225—Nov. 16, 1943
H. W. Rueger—U.S. Pat. No. 2,129,785—Sept. 13, 1938
R. E. Jones—U.S. Pat. No. 1,955,750—Apr. 24, 1934

The inventor is not aware of any prior art which is specifically pertinent to or anticipatory of the details of his invention as herein claimed.

SUMMARY OF THE INVENTION

Devices of the present invention are made of strip material, preferably sheet metal, and formed to include a ring or loop portion so that they may be slipped onto a thumb or finger of a hand for use. Preferred embodiments are particularly constructed to comfortably nest in the hand, available for use at any given time while permitting the use of the hand for purposes other than the manipulation of the attached device. These embodiments are particularly advantageous for use by persons working in bars where in the course of any given day they may be called upon frequently to open a can of beer or a can of some other beverage requested by a patron.

Devices of the present invention can be contrived in various forms. As herein illustrated, in preferred embodiments, they are fabricated using short narrow strips of materials, preferably sheet metal. As formed each embodies a ring or loop portion by means of which it may be slip-fit to a thumb or finger of a hand and a projected end portion formed so it may be easily and quickly slipped over the rim of a can and under the adjacent edge of the operating member to which it applies to serve as a wedge. The wedge effect may be enhanced by inclining a portion of the projected end portion at its outer limit. The projected end portion of the device is preferably provided with a pair of laterally spaced bearing portions on which it may be pivotally rocked on the top of the can to which it is applied as it is slipped under and inwardly of the operating member and smoothly moved by an appropriate rocking motion of the hand to flip the operating member up and over the detachable portion to which it connects. In this manner, there is sufficient pressure applied to forcefully, positively and quickly induce the detachable portion to break away from the body of the can and create the necessary opening therein through which the contents of the can can be poured. The nature and character of the various embodiments of the invention and the manner of mount thereof facilitate a natural assistance of the fingers of the hand to expedite and assure a total function of the device and the achievement of the intended result.

It is to be understood that the summary and following description is made with specific reference to the application of embodiments of the invention to the opening of beer cans of the construction first described. However, other applications of the invention are possible with similar benefits to the user, as will be readily obvious.

A primary object of the invention is to provide a device which may be easily and safely used for the purposes described which is economical to fabricate, more efficient and satisfactory in use and adaptable to a wide variety of applications.

A further object of the invention is to provide a simple device useful in the opening of a can a portion of the body of which is peripherally bounded at least in part by means producing a localized structural weakening in said body and has in connection therewith an operating member closely adhering to the body in its installed position characterized by said device being formed of strip material to include a ring or a loop portion for a slip-fit thereof to a finger and an end portion capable of the application thereof under the operating member to serve as a wedge and to be simply applied with a lateral movement of the hand to flip the operating member up and outwardly from the can, and thereby induce an opening through which the contents of the can may be poured. Another object is to provide a device of the type described which is substantially totally coiled on itself.

A further object of the invention is to provide devices of the type herein described capable of being slip-fit to the thumb or finger of a hand possessing the advantageous structural features, the inherent meritorious characteristics and the means and mode of use herein described.

With these and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein some but obviously not necessarily the only forms of embodiment of the invention are illustrated, FIG. 1 is a perspective view of one form of embodiment of the present invention;

Like parts are indicated by similar characters of reference throughout the several views.

Figure 1:
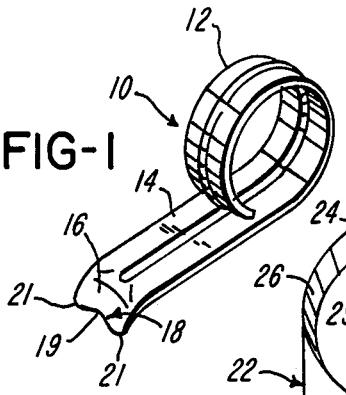

FIG. 1 illustrates a first embodiment of the invention which is fabricated from a single, narrow, relatively short, generally rectangular strip 10 of stainless steel. One end portion of the strip 10 is curved up and over a following portion thereof to form thereon a ring 12 having a generally uniform radius. The portion 14 of the strip 10 which immediately follows the ring 12 extends in a line substantially tangential thereto. The portion 14 is extended by a strip portion 16 which is angularly inclined from the line thereof. The strip portion 16 is very short in length and the angle by which it departs from the line of the portion 14 in the example shown in FIG. 1 is approximately 10 degrees. The projected extremity 18 of the strip portion 16 provides an edge portion of the strip 10 remote from the end thereof embodying the ring 12 which has a configuration comprised of three shallow arcs. The central arc 19 is laterally centered, concave, formed on a generally uniform radius and extended to either end thereof by a relatively short, convexly configured, arc 21. The arcs 21 are identically formed on the same radius, which is substantially less than that on which the arc 19 is formed. The rounded apex portions of the arcs 21 provide a pair of laterally spaced bearing portions on which the device provided by the strip 10 can be rocked in the application thereof for the purposes herein described. As shown, the strip 10, for essentially the major portion of its length, is formed to include a laterally centered, longitudinally extended rib, lending it additional firmness or strength, which for certain applications is desirable.

Figure 6:
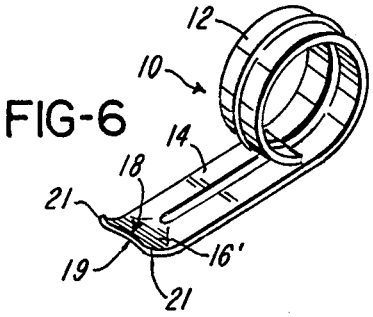
FIG. 6 is a perspective view of a modification of the device of FIG. 1.

FIG. 6 illustrates a second form of embodiment of the invention the construction of which is identical in all respects to that of the embodiment of FIG. 1 except that the strip portion 16, here designated as 16', is in this instance bent oppositely so it projects in the same direction as the ring portion 12. As should be obvious, this is advantageous where there is particularly limited space and tightness of the operating member to the top of the can. It permits the application of the invention device, initially, at a more appropriate angle to the top of the can to have the leading end thereof come under and pry the outer end of the operating member up and to lever it upwardly as the strip portions 16' and 14 are directed inwardly towards the root of the operating member.

In the case of both the embodiment of FIG. 1 and that of FIG. 6 the projected end portion 16, 16' forms, with the strip portion 14, a wedge the benefit of which should be made obvious from the description of the use thereof which follows.

Figure 7:
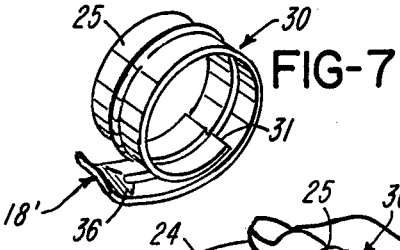
FIG. 7 illustrates a further embodiment of the invention which may be applied to the thumb or a finger of the user.

A third form of embodiment of the invention shown in FIG. 7 exhibits a single, narrow, relatively short, generally rectangular strip 30 which is somewhat shorter in length than the strip 10. In this instance the strip 10 is coiled on itself from one end 31 to provide that the major extent of the length thereof is formed as a ring 25, at the outer limit of which projects a relatively short end portion 36 which corresponds to a composite of the strip portions 14 and 16, 16' of the embodiments of FIG. 1 and 6. The end portion 36 terminates in a projected edge 18' the construction and configuration of which corresponds to that of the edge 18 of the previously described embodiments.

The construction of the edge 18, 18' as herein shown and described is preferred. However, it may be formed straight or otherwise formed as may be determined suitable for the intended use of the device of which it forms a part without loss of the basic benefits of the invention.

In each preferred embodiment, though the strip of which it is formed is rigid, the ring portion thereof can be adjusted to adapt the device for application to different size fingers and thumbs.

Figure 2:
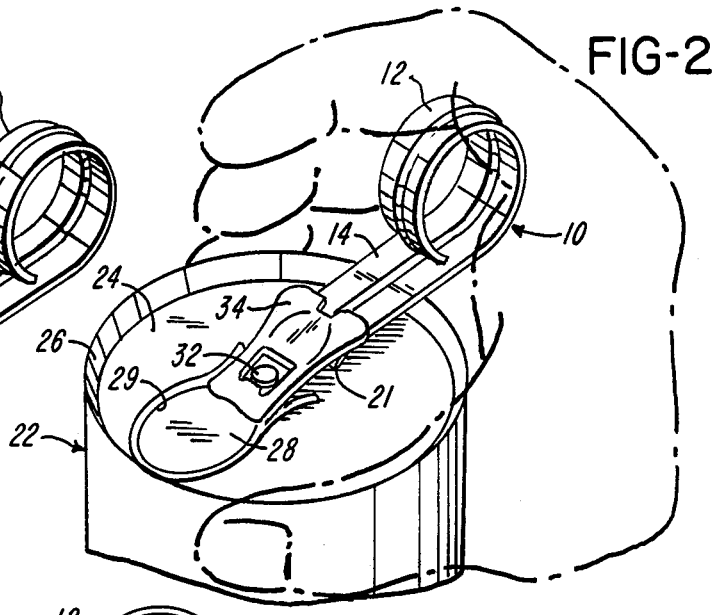
FIG. 2 is a perspective view illustrating one manner of application of the device of FIG. 1 to a finger of a hand and the commencement of the use thereof for the opening of a can of beer.
Figure 3:
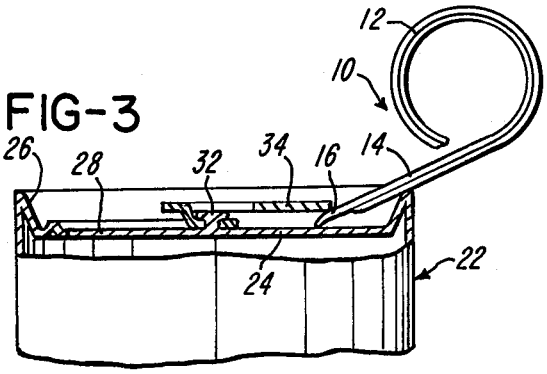
FIG. 3 is a side elevation of the structure of FIG. 2 with a portion of the can as therein illustrated shown partly in section to further demonstrate the manner in which the device of FIG. 1 is applied to the tab-like operating member in connection with the can.
Figure 4:
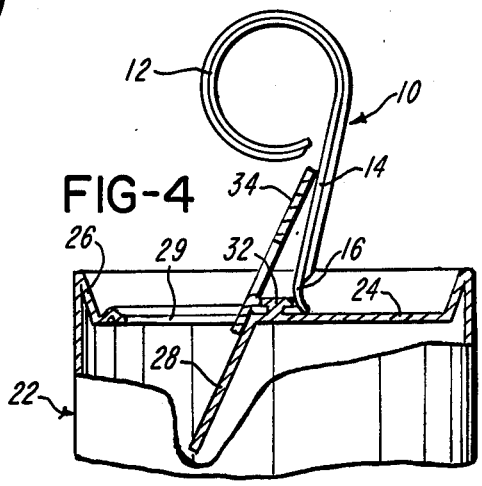
FIG. 4 is a further sectional view showing the completion of the procedure of opening a can the commencement of which is illustrated in FIGS. 2 and 3.

FIGS. 2–4 of the drawings demonstrate an application of the device of FIG. 1 to open a beer can 22. As here illustrated, the can 22 is a sealed container having a hollow cylindrical body the outer periphery of the top 24 of which is bounded by an upstanding rim 26. A portion 28 of the top of the can extending radially thereof from its center and almost to the rim 26 is bounded on its generally radial sides and its outermost end by a continuous score line 29. The score line 29 defines a structurally weakened portion of the top of the can. Fixed to the portion 28, within its radial limits and adjacent but spaced outwardly from the center of the top of the can, by a rivet 32, is one end of a metal tab constituting an operating member in the form of a lever 34. The tab-like lever 34 is a direct extension of the radial innermost end of the portion 28. As may be seen from the drawings, the end of the lever 34 connected to the portion 28 by rivet 32 overlaps its radial innermost end and extends diametrically across the top of the can, in a relatively snugly and closely positioned relation thereto, terminating at its radial outermost end in an immediately adjacent spaced relation to a base portion of the rim 26.

It was the intent of the manufacturers of cans of the type represented by the beer can 22 that, after the filling and capping of the body thereof by its top portion, the can should be provided with an opening by lifting the lever 34 at its radially outermost end and rocking it up and over to influence, through pressure applied to the can portion 28, a breaking free of the portion 28 and a depressing thereof inwardly of the body of the can, thereby to provide an opening through which the contents of the can may be poured.

What the designers of cans such as the beer can 22 have overlooked is the difficulty and injury that has often been encountered in grasping and manipulating the operating lever provided for opening the can. In use of embodiments of the present invention, to achieve the opening of a can similar to the can 22 one is able to not only quickly and easily open the can but to avoid any injury or damage to a finger or fingernail of the person engaged in this procedure.

The devices of the present invention can be utilized in various manner but for purpose of this disclosure only one mode of its use and application need be described. Others will be self-evident and may be chosen to suit the convenience of the user. By way of example, considering the device of FIG. 1, for the opening of the can 22 the user may slip the middle finger of his or her hand through the ring 12. With the invention device so applied the strip portion 14 will tend to abut the forefinger immediately of the palm of the hand and have the end portion 16 project in the direction of its thumb. The user may then grip the body of the can, with one hand, from the side thereof opposite that in the direction of which the lever element 24 projects. Then with a lateral movement of the other hand, to which the invention device has been applied, the user can easily and quickly slip the projected end portion 16 of the strip 10 over the rim 26 and inwardly of the limited space between the rim and the outermost end of the lever 34 to apply the edge 18 of its projected extremity and in particular the portions 20 thereof to bear on the top of the can immediately of the outermost end of the lever and in line therewith.

As may be seen in the drawings, as the device of FIG. 1 is so applied, the hand on which it is worn will tend naturally to cup around the top of the can at the side thereof opposite that which is gripped. This disposition of the device and its mounting to the hand will inherently facilitate that without hesitation there may be, in a single motion, a fast and sure sliding of its wedge portion 18, 16, 14 under the lever 34 to a point immediately adjacent the rivet 32 whereupon with a quick flip of the hand about a pivot line defined by the laterally spaced bearing portions 21 at the leading end of the strip 10, the device can be rocked over the top of the can, carrying the lever 34 therewith. The result is a firm and immediate pressuring of the can portion 28 to induce it to break away from its bounding score line, thereby to produce an opening in the can for discharge of its contents. By reason of the inherently balanced application of the strip 10, the opening operation is an almost instantaneous procedure.

Figure 5:
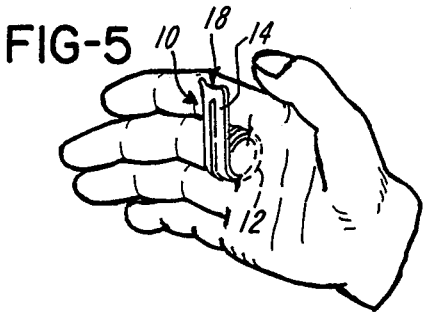
FIG. 5 illustrates how the device of FIG. 1 may be nested in the hand while not in use.

Take particular note of FIG. 5 which demonstrates that the device of FIG. 1 can be readily maintained in connection with the hand to which it is applied, so as to be available for repeated and intermittent use while at the same time leaving the hand and fingers thereof free to carry out other tasks.

It should be obvious that the device of FIG. 6 can be applied and utilized in a manner similar to that demonstrated and described with reference to the device of FIG. 1. This device is less preferred but it does have some advantage where the space between the outer end of the lever 34 and the rim of the can is extremely limited.

Figure 8:
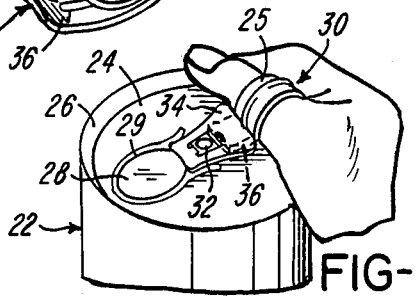
FIG. 8 is a view like that shown in FIG. 2 which similarly illustrates the modification of FIG. 7 as applied to the opening of a beer can.

In use of the third form of embodiment of the invention shown in FIG. 7 its ring portion 25, depending on its size, may be slipped over a finger or thumb of a hand. The method of its application to the lever 34 is essentially the same as that previously described. In the example of its application illustrated in FIG. 8, the ring portion 25 is on the thumb of the hand and, holding it between the thumb and the adjacent forefinger, its leading projected end portion 18' may be advanced and slid over the rim 26 of the can 22 immediately adjacent the outer end of the lever 34 and under this lever to the extent and substantially in the manner described previously with reference to the embodiments of the FIGS. 1 and 6. In this case in the course of the advancement of the end portion 18' under the lever 34, the lever is effectively gripped between portions of the coil of the ring 25 so that on flipping of the thumb upwardly and over the top of the can there is an unusually firm and positive control of the lever and an extremely rapid opening of the can. This embodiment as well as the others may be kept on a hand for extended periods of time without discomfort or affecting the use of the hand.

From the foregoing it should be clearly evident that the invention provides devices which are not only capable of economical fabrication but easy, positive and safe to use. Embodiments can be applied equally to tab like operating portions such as the lever 34 and those having ring configurations, with similar advantage and effect. As previously indicated, the embodiments of the invention may be modified to suit the intended application without departing from the spirit and scope of the appended claims.

It should also be obvious that devices in accordance with the invention may have beneficial application in facilitating the opening of cans wherein a portion to the top thereof, such as the portion 28, may be fully circumscribed by a score line to enable it to be pulled completely free of the top of the can through the medium of an attached tab-like operating member.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus facilitating a quick and trouble free opening of a beer or other beverage can having a body an end portion of which is defined by a recessed surface rimmed peripherally by an axially projected upstanding rim, which end surface has a portion thereof peripherally bounded at least in part by a line wherein said body is structurally weakened, which line is located in part adjacent a portion of said rim and said portion of said end surface has an attached tab extending therefrom in a substantially flat closely adherent relation to said end surface to have its end remote from its attachment closely adjacent said rim, said apparatus comprising a short, relatively narrow strip of relatively strong durable material, an extended portion of the length of said strip including one end thereof being coiled over a portion of one face of said strip in the direction of the opposite end thereof, said coiled portion being configured for the insertion therein of a finger of the hand of a user of said apparatus, a further portion of said strip including said opposite end thereof being formed as a wedge the leading edge of which is configured to provide for a simple and quick slip fit thereof under said remote end of said tab and over the portion of said end surface thereunder in the direction of the point of said attachment of said tab to said end surface and said wedge including means on which said strip may be pivoted upwardly and over said end surface to induce relative sliding movement of said remote end of said tab up the backing surface provided by said strip to smoothly and easily and with little exertion apply forces to said tab effective to substantially immediately thereof produce a separation in said end surface on said weakened line thereof and a displacement of said portion thereof bounded by said line to create a pour spout thereby.

2. Apparatus as in claim 1 wherein said means on which said strip is pivoted in use is provided as part of the leading end portion of said wedge, is formed to provide a bearing relation thereof to said end surface, a smooth and resistance free application of said wedge under said tab and said sliding movement of said remote end of the tab up its backing surface to provide said pour spout in said can in the course of of a single continuous, extremely brief, rocking movement of the hand of the user, to a finger of which said strip is applied, across and over said end surface of said can.

3. Apparatus as in claim 1 wherein said means on which said strip may be pivoted is at the extremity of said strip defined by said opposite end thereof and presents an arcuately configured surface portion of said strip.

4. Apparatus as in claim 1 wherein said means on which said strip may be pivoted is at the extremity of said strip defined by said opposite end thereof and includes two arcuately formed bearing portions which are spaced laterally thereof.

5. Apparatus as in claim 1 wherein a portion of the length of said strip immediately of said coiled portion thereof extends from and substantially tangential to said coil and terminates in said wedge which includes in connection therewith means on which said strip can be rocked on said end surface to produce said pivoting of said strip and the consequent relatively sliding movement of said tab as a continuation of the introduction of said wedge under said tab.

6. Apparatus as in claim 1 wherein said strip is a segment of sheet material and substantially rigid.

7. Apparatus as in claim 1 wherein a very short portion of the length of said strip including said opposite end thereof is smoothly and angularly diverted from the line of the immediately preceding portion of said strip to form said wedge.

8. Apparatus as in claim 7 wherein said wedge portion of said strip is relatively close to said coiled portion of said strip.

9. Apparatus as in claim 1 wherein the operative surface of said wedge portion presents a departure from the line of the preceding portion of said strip which defines a shallow slope therefrom to its leading edge which is defined by said opposite end of said strip.

10. Apparatus as in claim 1 wherein said wedge is essentially a direct continuation of said coiled portion of said strip.

11. Apparatus facilitating a quick and trouble free opening of a beer or other beverage can having an end wall recessed relative the projected extremity of a bounding outwardly projected rim, a segment of which end wall is bounded by a weakened portion thereof and has attached thereto a tab-like lever snugly and closely fit to said end wall and terminating at its radially outermost end immediately adjacent and in closely spaced relation to the base of said rim comprising a short, narrow, relatively rigid strip of sheet material a substantial portion of the length of which is coiled over one surface thereof to defined a loop forming a finger or thumb receiving portion of said strip for the user of said apparatus, a short portion of said strip at the end thereof remote from said coiled portion having a shallow wedge-like shape and bearing means in connection therewith, said wedge-like shape having a leading edge portion applicable over said rim and between the outermost end of said tab and said bounding rim and formed to readily slip fit under and inwardly of said tab to the vicinity of its attachment to provide a bearing backing surface for said tab and said wedge-like shape further providing bearing means in connection therewith on which, in a continuing rocking movement of said strip is effective to induce relative sliding movement of said remote end of said tab up the backing surface provided by said strip to smoothly and easily and with little exertion apply forces to said tab effective to substantially immediately produce therethrough a separation in said end surface on said weakened portion thereof and a displacement of said portion of said end wall bounded thereby to create a pour spout in said can.

12. Apparatus as in claim 11 wherein said strip has a substantially laterally centered longitudinally extending rib projected outwardly of said backing surface on which said tab bears in the course of its sliding movement on and relative to said backing surface.

13. Apparatus as in claim 11 wherein the end portion of said strip remote from said coiled portion has an arcuate shape which provides said bearing means.

14. Apparatus as in claim 11 wherein said means on which said strip is rocked in use is provided as part of the leading edge of said wedge, is formed to provide a bearing relation thereof to said end surface, a smooth and resistance free application of said wedge under said tab and said sliding movement of said remote end of the tab up its backing surface to provide said pour spout in said can in the course of of a single continuous, extemely brief, rocking movement of the hand of the user, to a finger of which said strip is applied, across and over said end surface of said can.

15. Apparatus as in claim 11 wherein said shallow wedge-like shape is provided by a short end portion of said strip following said coiled portion thereof which is smoothly and relatively slightly deflected from the direction of the immediately preceding portion of the strip.

* * * * *

UNITED STATES PATENT OFFICE
CERTIFICATE OF CORRECTION

Patent No. 4,765,208 Dated August 23, 1988

Inventor(s) Richard C. Sakosky

It is certified that error appears in the above-identified patent and that said Letters Patent are hereby corrected as shown below:

Col. 8, line 25 (Cl. 11, line 12) "defined" is corrected to read -- define --.

The zip code appended to Patentee's address is corrected to read -- 45432 --.

Signed and Sealed this

Twentieth Day of December, 1988

*Attest:*

DONALD J. QUIGG

*Attesting Officer*

*Commissioner of Patents and Trademarks*